US011466951B2

(12) United States Patent
Vaughan et al.

(10) Patent No.: US 11,466,951 B2
(45) Date of Patent: Oct. 11, 2022

(54) CONDITIONAL LOCKING MECHANISM FOR HANDGUNS

(71) Applicant: Franklin Armory Holdings, Inc., Minden, NV (US)

(72) Inventors: Grant Vaughan, Carson City, NV (US); David Gockel, Carson City, NV (US)

(73) Assignee: FRANKLIN ARMORY HOLDINGS, INC., Minden, NV (US)

( * ) Notice: Subject to any disclaimer, the term of this patent is extended or adjusted under 35 U.S.C. 154(b) by 0 days.

(21) Appl. No.: 17/587,156

(22) Filed: Jan. 28, 2022

(65) Prior Publication Data

US 2022/0252366 A1 Aug. 11, 2022

Related U.S. Application Data

(60) Provisional application No. 63/147,360, filed on Feb. 9, 2021.

(51) Int. Cl.
*F41A 3/42* (2006.01)
*F41A 17/62* (2006.01)

(52) U.S. Cl.
CPC ..... *F41A 17/62* (2013.01); *F41A 3/42* (2013.01)

(58) Field of Classification Search
CPC ..... F41A 17/62; F41A 17/46; F41A 17/48; F41A 17/56; F41A 17/4258; F41A 19/06; F41A 19/10; F41A 19/12; F41A 19/24; F41A 3/64; F41A 3/42; F41A 3/68; F41A 3/70; F41A 5/14; F41A 5/24; F41A 9/23; F41A 9/52
USPC ..... 42/70.05
See application file for complete search history.

(56) References Cited

U.S. PATENT DOCUMENTS

| | | | | |
|---|---|---|---|---|
| 4,176,584 | A * | 12/1979 | Thomas, Jr. | F41A 17/38 89/196 |
| 5,042,185 | A * | 8/1991 | Justice, Sr. | F41A 17/74 42/70.11 |
| 6,314,859 | B1 * | 11/2001 | Weichert | F41A 3/86 42/1.06 |
| 10,378,838 | B2 * | 8/2019 | Hopkins | F41A 3/42 |
| 11,168,952 | B2 * | 11/2021 | Palkow | F41A 21/30 |
| 2019/0086169 | A1 * | 3/2019 | Hopkins | F41A 3/68 |

FOREIGN PATENT DOCUMENTS

| | | | | |
|---|---|---|---|---|
| WO | WO-9410524 | A1 * | 5/1994 | F41A 19/12 |

* cited by examiner

*Primary Examiner* — John Cooper
(74) *Attorney, Agent, or Firm* — Bennet K. Langlotz; Langlotz Patent & Trademark Works, LLC

(57) ABSTRACT

A pistol comprises a frame with a slide operable to reciprocate on the frame. A trigger movably connected to the frame to move between a forward position and rear position, and a block element selectably interfacing with the slide and movable between a released position in which the slide is enabled to reciprocate and a locked position in which the slide is prevented from reciprocation. The block element is operably engaged to the trigger to move to the locked position when the trigger is in the rear position, such that the slide does not recoil after discharge when the trigger is held to the rear position.

1 Claim, 8 Drawing Sheets

CONDITIONAL LOCKING MECHANISM FOR HANDGUNS

CROSS-REFERENCE TO RELATED APPLICATIONS

This application claims the benefit of U.S. Provisional Patent Application Ser. No. 63/147,360, filed on Feb. 9, 2021, entitled "CONDITIONAL LOCKING MECHANISM FOR HANDGUN", which is hereby incorporated by reference in its entirety for all that is taught and disclosed therein.

FIELD OF THE INVENTION

The present invention relates to locking mechanisms for handguns.

BACKGROUND AND SUMMARY

Most semiautomatic pistols use a short recoil mechanism where the barrel and slide recoil together momentarily and separate when the barrel is redirected downward by a pin or locking block to unlock it from the slide, which continues recoiling.

In certain scenarios, it can be advantageous or even necessary to lock the slide and barrel assembly to prevent semiautomatic action. Because the slide needs to be actuated to load a cartridge into the chamber and to unload the fired shell, any locking mechanism would have to be selectable or conditional. One obvious condition for this locking to occur is when the trigger must be pulled. This will lock the barrel and slide in battery when the firearm is discharged and unlock it when the trigger is released in order to permit the manual cycling of the weapon.

The above disadvantage is addressed by a pistol comprises a frame with a slide operable to reciprocate on the frame. A trigger movably connected to the frame to move between a forward position and rear position, and a block element selectably interfacing with the slide and movable between a released position in which the slide is enabled to reciprocate and a locked position in which the slide is prevented from reciprocation. The block element is operably engaged to the trigger to move to the locked position when the trigger is in the rear position, such that the slide does not recoil after discharge when the trigger is held to the rear position.

DETAILED DESCRIPTION OF A PREFERRED EMBODIMENT

An additional application for a conditional locking mechanism is for use with an external selector lever. The selector lever can serve to activate or deactivate the locking mechanism so that, when the selector lever is active and the trigger is pulled, the slide and barrel assembly are locked, but when the selector lever is deactivated and the trigger is pulled, the weapon functions in a semiautomatic manner and the locking mechanism is disengaged. This design has a practical application for use in combination with sound reduction devices.

This conditional locking mechanism is different from any similar system currently being produced. A device that serves a similar purpose is present on the HK Mark 23. It allows the user to lock the slide and unlock the slide, but this requires a separate motion and remains locked after the shot has been fired until it is manually unlocked. The conditional locking mechanism locks the slide automatically when the trigger is pulled and unlocks it when the trigger is released. Both require the slide to be manually operated. There are no other devices that lock the slide to prevent semi-automatic function when the trigger is pulled. The addition of this technology serves two purposes: prevents semi-automatic function for use in restrictive jurisdictions, and eliminates action noise when used with a sound reduction device. The invention includes a trigger sear which can translate, rotate, or a combination of both in order to release a striker or to pull back and release a striker. The trigger sear is generally spring biased upward depending on its orientation in relation to the striker, hammer, or other firing mechanism.

Figure 5:
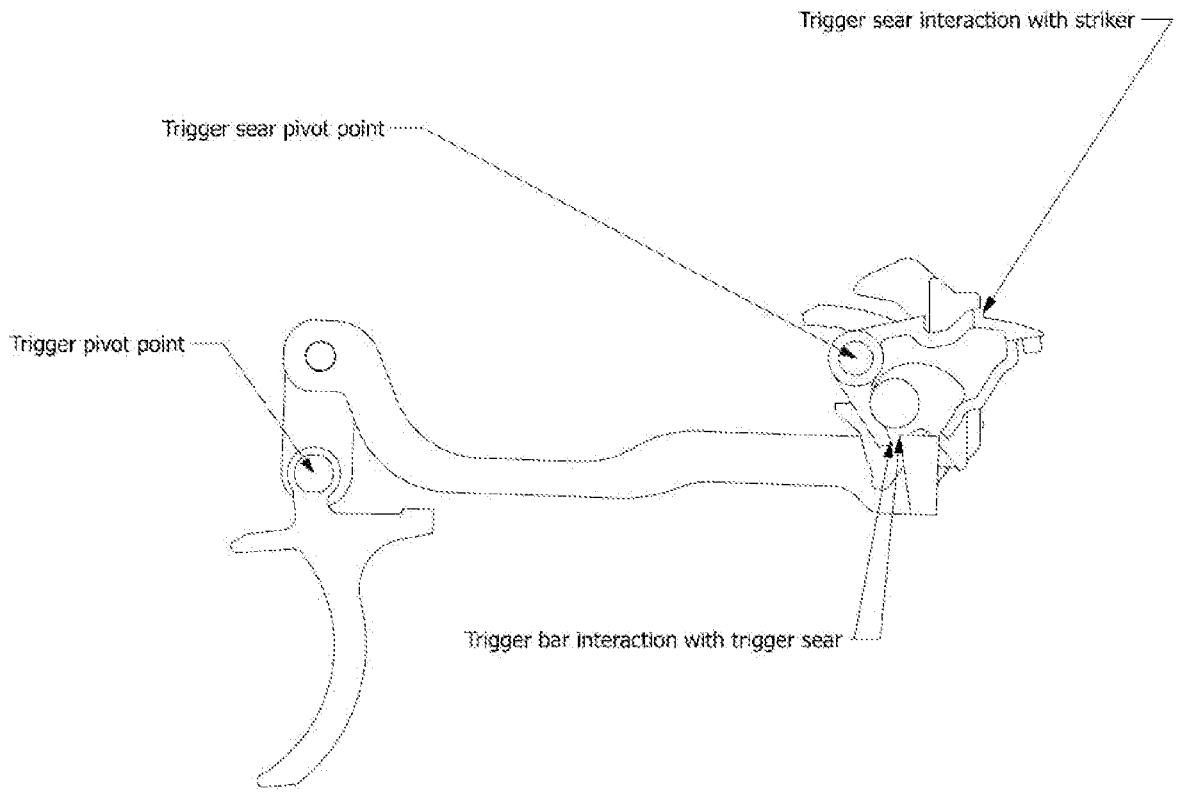
FIG. 5 is a view from left side showing interfaces between parts.

The invention includes a trigger linkage bar (or trigger bar) which connects the trigger to the trigger sear and several other trigger actuated parts. The interaction between the trigger and the trigger bar is shown in FIG. 5. The trigger linkage bar may be integral to the trigger sear. The trigger linkage bar is generally spring biased in the same manner as the trigger and may receive or be used to impute spring bias to the trigger.

Figure 3:
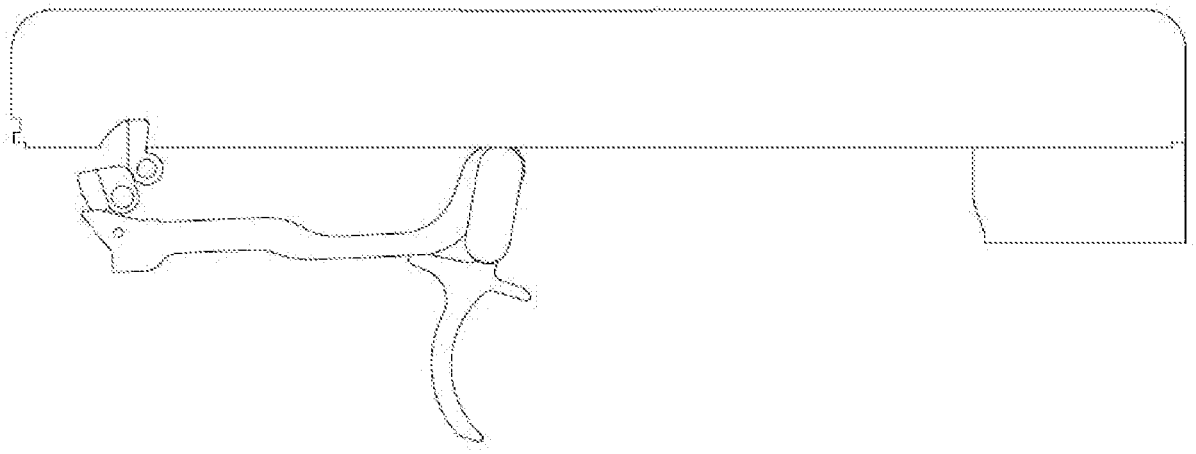
FIG. 3 is a view showing only parts critical to patent.

The invention includes a slide or bolt which may reciprocate on the weapon frame or on guide surfaces and serves to contain the cartridge and pressure resulting from the firing of the cartridge. The slide or bolt may be spring biased forward to help it return to battery. The slide is depicted in FIG. 3 as a Sig Sauer System style handgun, but may function in other ways such as a rotating bolt, a falling block, rotating chamber or barrel, blowback, or delayed blowback.

The invention also contains the barrel which locks into the slide such that it may not be unlocked without displacing the slide or bolt. The barrel also contains the pressure resulting from discharging the cartridge and directs the projectile.

Figure 1:
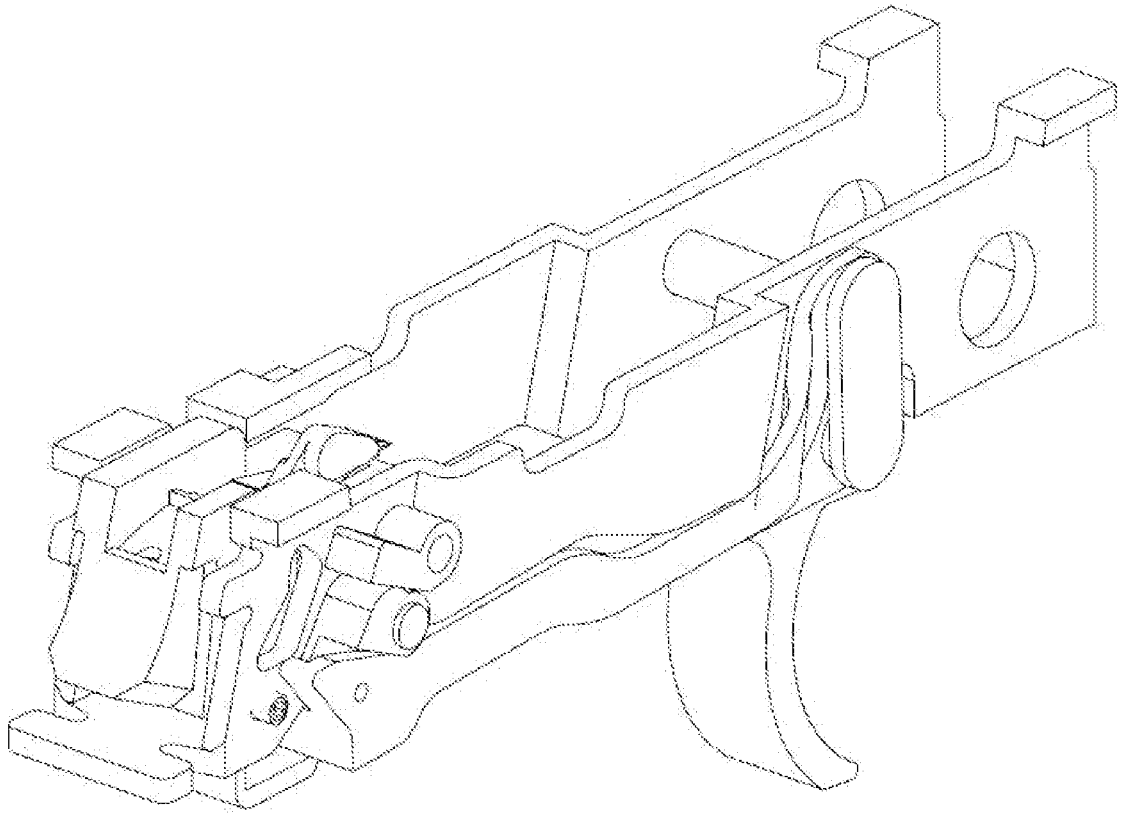
FIG. 1 is an isometric view of trigger, trigger bar, frame, trigger sear, firing pin safety, disconnector, locking lug, locking cam, sear pin, and selector pin.
Figure 2:
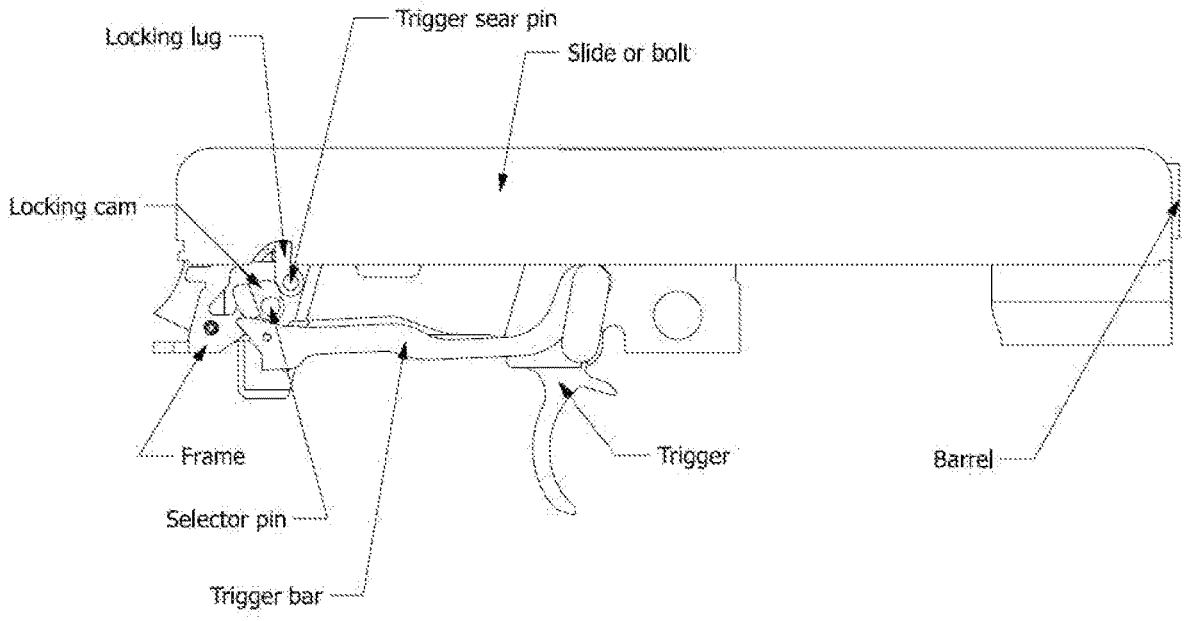
FIG. 2 is an identification of most major parts in assembly.
Figure 4:
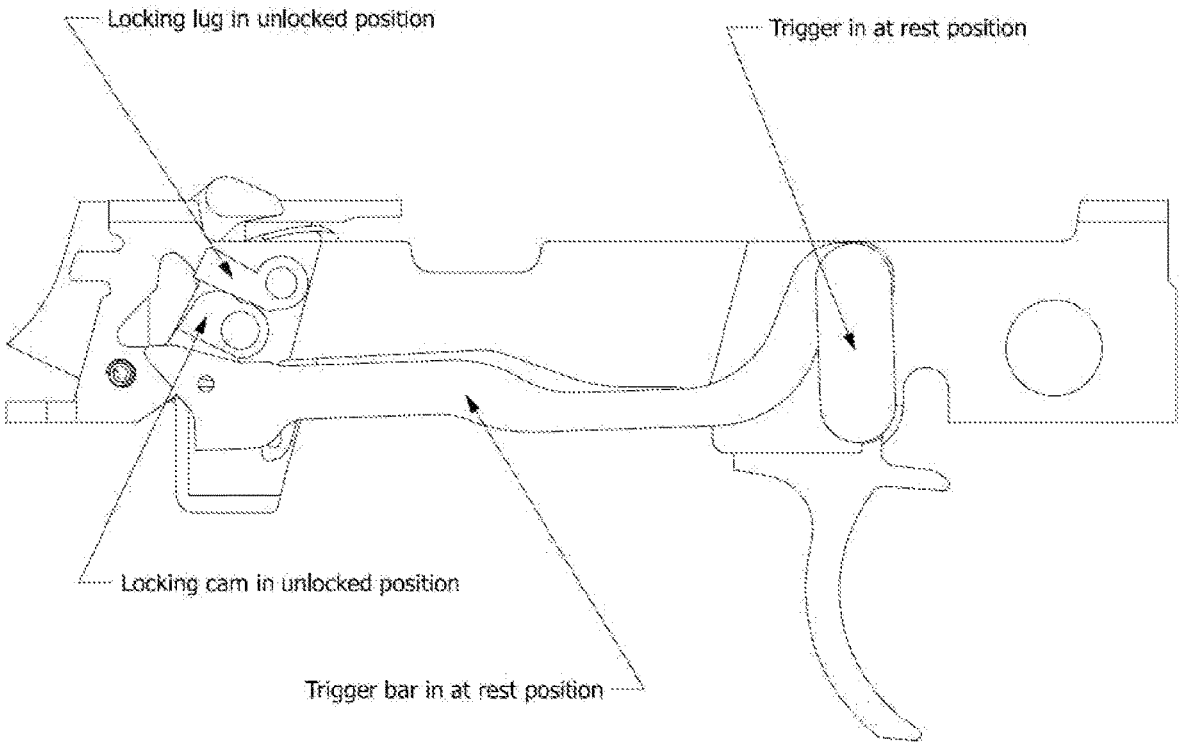
FIG. 4 is a view showing parts in unlocked position.

The invention includes a frame which houses and partially constrains the motion of the trigger, houses the trigger bar, houses and partially constrains the motion of the trigger sear, includes rails or the provision for mounting rails which allow the slide or bolt to reciprocate to load or unload the cartridge or fired brass, and can include a camming pin or surface for aiding in the unlocking of the barrel or the provision for mounting such a pin or surface. The frame may also include holes, slots, or other provisions for mounting or positioning pins or other parts. The frame may be one piece or a permanent or non-permanent assembly of several pieces. The frame may also include provision for holding a feeding device and mounting accessories. The frame is shown in FIGS. 1, 2, and 4.

The invention includes a locking lug which prevents the slide or bolt from moving such that it will unlock from the barrel. The locking lug may translate or rotate or a combination of both into a locked position when activated. It may contain a camming surface or gear teeth in addition to at least one locking lug surface in order to interface with the locking cam. It is spring biased to the unlocked position. It may also include the provision to interface with other locking lugs in different locations on the weapon or on the other side of the weapon such that they move in a coordinated, simultaneous manner. The locking lug is depicted in FIG. 2 in the locked position and in FIG. 4 in the unlocked position.

Figure 6:
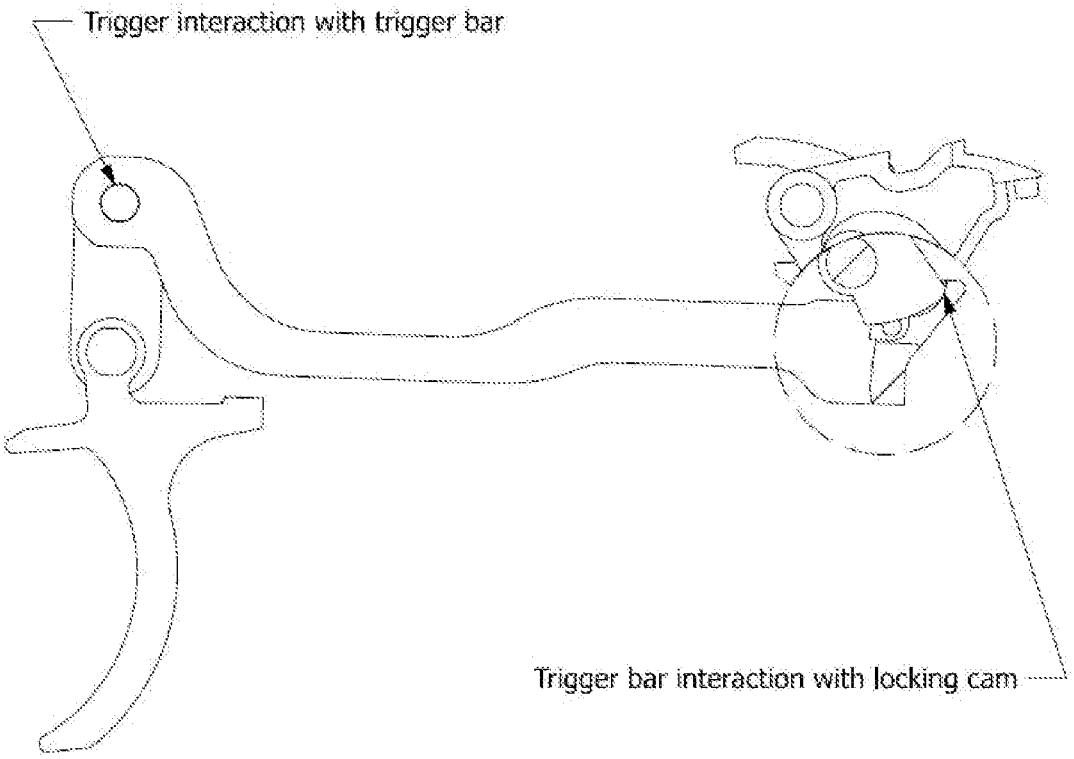
FIG. 6 is a view from left side showing interaction between parts containing section view of trigger bar and locking cam.

The invention includes a locking cam which may be actuated directly by the trigger or indirectly by the trigger using the trigger bar as shown in FIG. 6. The locking cam may include a camming surface or gear teeth or lugs to cause the translation or rotation or a combination of both of the locking lug in order to lock the slide or bolt. The locking cam may contain geometry such that it utilizes a mechanical advantage in order to impede the motion of the locking lug once it is in the locked position. The locking cam may also include geometry to allow it to disengage from the trigger bar such that it no longer moves when the trigger bar is actuated. The locking cam may also include geometry to allow it to disengage from the locking lug such that when the trigger bar is actuated and results in motion of the locking cam, the locking cam does not interface with the locking lug in a way which would result in motion. This locking cam may be integral to the locking lug.

The invention also includes a selector lever pin. This pin directs the translational or rotational motion of the locking cam and or the locking lug. It may also include a lever handle designed to be actuated by the user to selectively engage or disengage the locking cam and or the locking lug.

These parts are generally manufactured out of some kind of load bearing and wear resistant material such as steel, but some may be manufactured out of other materials such as plastics, polymers, composites, or non-ferrous metals as appropriate. The parts may be manufactured by injection molding, casting, metal injection molding, stamping, fine-blanking, waterjet cut, laser cut, machined, or EDM. Some of the parts such as springs and linkages may be wire drawn or extruded. The parts and or springs may also be treated, coated, or processed to improve surface hardness, toughness, strength, to reduce friction, to prevent corrosion, or to improve aesthetics.

Figure 7:
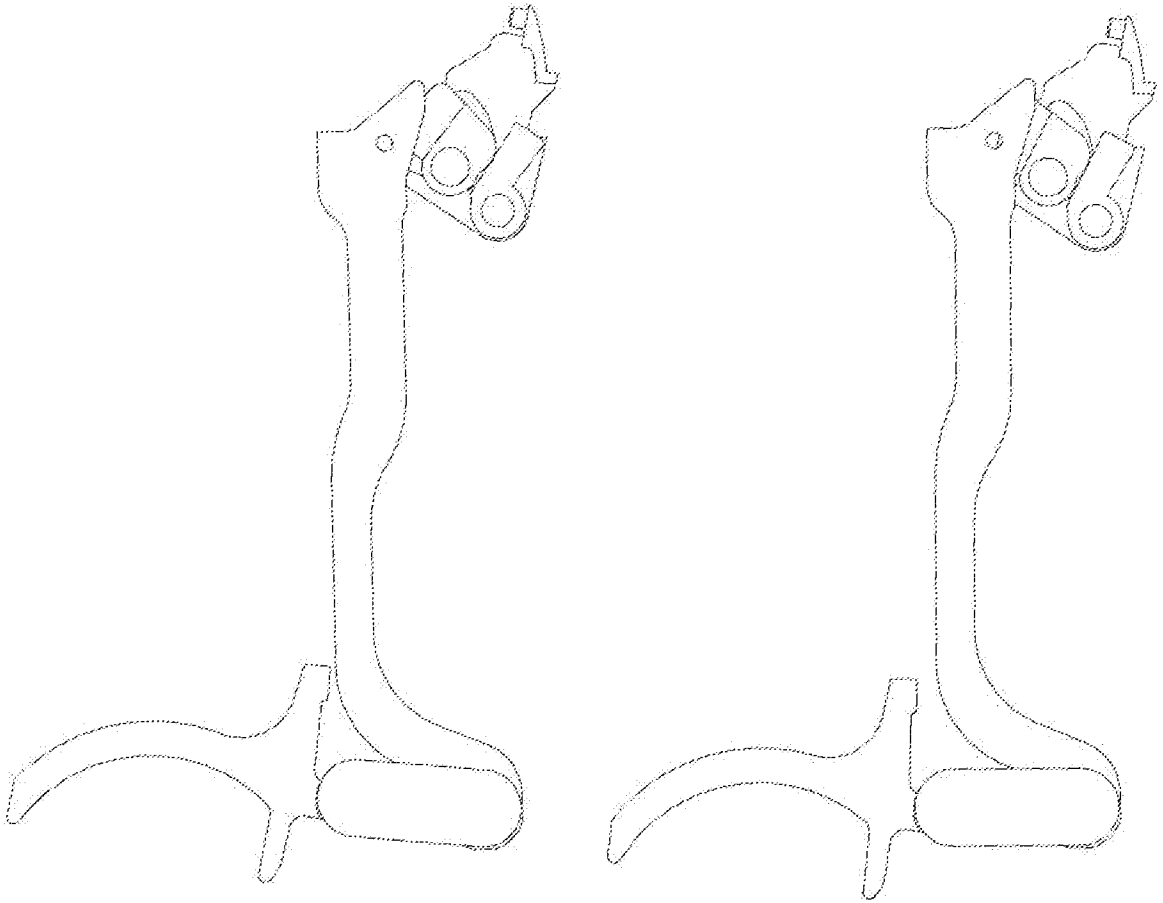
FIG. 7 is a view showing the trigger pull and motion of important parts in the first two steps.
Figure 8:
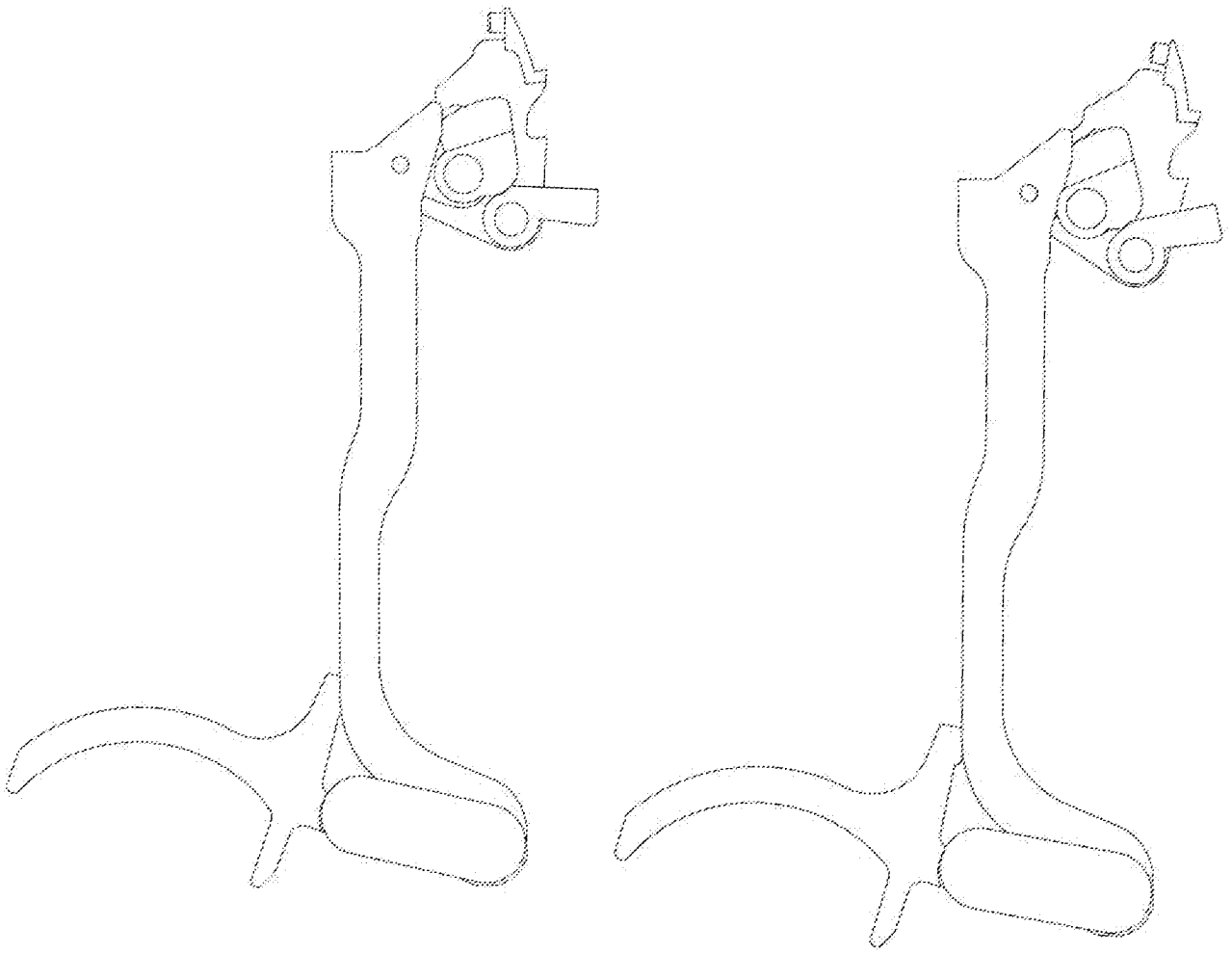
FIG. 8 is a view showing the trigger pull and motion of important parts in the last two steps.

The sequence of operations is:

The invention has two modes of operation. The first mode is when the conditional locking mechanism is activated. The selector pin is actuated to the activated position, and the mechanism starts from its rest state. The trigger is then pulled by the user. Depending on the design of the weapon, this pulls or pushes the trigger bar. The trigger bar then causes the locking cam to rotate. The locking cam rotates and rotates or translates the locking lug into its locked position so that it impedes the motion of the slide or bolt. The locking cam then cams the locking lug into place so that the locking lug can not move freely due to a mechanical advantage between the locking lug and the locking cam. While depicted as a cam, gear teeth could be used instead. Both of these pieces are depicted as moving rotationally, but one or both could be translational. The trigger bar also acts upon the trigger sear to depress it and release the striker. This design is also applicable to weapons where the trigger sear is integral to the trigger bar. This sequence of operations is shown in FIG. 7. When the weapon slide or bolt is locked by the locking lug as shown in FIG. 2 and the trigger sear is depressed, the weapon may discharge but due to the locking lug, the slide or bolt will not recoil in a semiautomatic manner. When the trigger is released by the user, the trigger and trigger bar return to their at-rest positions and releases the locking cam as well as any other parts it may have been acting upon. The locking cam releases the locking lug and allows it to move into its unlocked position. The slide or bolt is then manually cycled by the user to extract and eject the fired shell and to load an unfired cartridge and reset the striker on the striker sear. The cycle may then be completed again.

The second mode of operation occurs when the selector pin is actuated to the deactivated position. It may be held in place with a detent. The selector pin then disengages the locking cam or the locking lug or both by rotating them beyond their normal range of motion. This can be accomplished by an interrupted circular profile in the locking cam which allows the locking cam to pivot a specified amount when activated, but when deactivated, changes the at rest orientation of the locking cam such that it can no longer activate the locking lug or such that it is no longer activated by the trigger bar. This can also be done by using a cutaway in the selector pin to displace a translating locking cam or locking lug. It may also be done by using a wedge feature on the selector pin to laterally translate the locking cam so that it can rotate or slide in the same manner it could when activated but will not activate the locking lug. With the conditional locking mechanism deactivated, the trigger may be pulled by the user. This actuates the trigger bar and causes the trigger sear to release the striker. The cartridge is fired and the barrel and slide or bolt move rearwards before the barrel interacts with a caroming pin or surface which redirects it so that it unlocks from the slide or bolt. The slide or bolt then continues to recoil for its full range of motion and extracts and ejects the fired shell and loads an unfired cartridge. The striker is then retained by the trigger sear and the weapon is ready to fire again when the user pulls the trigger. When the conditional locking mechanism deactivated, no impedance is introduced to semiautomatic fire. The conditional locking mechanism may also be configured in such a way that it is activated every time the trigger is pulled and contains no provision for deactivating by the user in order to cause the weapon to become a manually cycled bolt action and prevent semiautomatic function.

We claim:

1. A pistol comprising:

A frame;

a slide operable to reciprocate on the frame;

A trigger movably connected to the frame to move between a forward position and rear position;

a block element selectably interfacing with the slide and movable between a released position in which the slide is enabled to reciprocate and a locked position in which the slide is prevented from reciprocation;

the block element operably engaged to the trigger to move to the locked position when the trigger is in the rear position, such that the slide does not recoil after discharge when the trigger is held to the rear position.

* * * * *